US011724153B2

(12) United States Patent
Jones

(10) Patent No.: US 11,724,153 B2
(45) Date of Patent: Aug. 15, 2023

(54) MULTI-PURPOSE EXERCISE DEVICE

(71) Applicant: Andrew Jones, San Jacinto, CA (US)

(72) Inventor: Andrew Jones, San Jacinto, CA (US)

(73) Assignee: Andrew Jones, San Jacinto, CA (US)

( * ) Notice: Subject to any disclaimer, the term of this patent is extended or adjusted under 35 U.S.C. 154(b) by 1 day.

(21) Appl. No.: 17/208,267

(22) Filed: Mar. 22, 2021

(65) Prior Publication Data

US 2021/0331026 A1 Oct. 28, 2021

Related U.S. Application Data

(60) Provisional application No. 63/013,799, filed on Apr. 22, 2020.

(51) Int. Cl.

| | |
|---|---|
| ***A63B 22/20*** | (2006.01) |
| ***A63B 23/035*** | (2006.01) |
| ***A63B 21/16*** | (2006.01) |
| ***A63B 23/12*** | (2006.01) |
| ***A63B 21/00*** | (2006.01) |
| ***A63B 21/068*** | (2006.01) |
| ***A63B 23/02*** | (2006.01) |

(52) U.S. Cl.

CPC ..... *A63B 22/20* (2013.01); *A63B 21/169* (2015.10); *A63B 21/1636* (2013.01); *A63B 21/4035* (2015.10); *A63B 23/03525* (2013.01); *A63B 23/1218* (2013.01); *A63B 23/1227* (2013.01); *A63B 21/068* (2013.01); *A63B 21/4047* (2015.10); *A63B 23/0211* (2013.01); *A63B 2225/10* (2013.01)

(58) Field of Classification Search

CPC ... A63B 21/0004; A63B 21/22; A63B 21/222; A63B 21/225; A63B 21/04; A63B 21/0407; A63B 21/0435; A63B 21/169; A63B 21/1618; A63B 21/1627; A63B 21/1636; A63B 21/1645; A63B 21/1654; A63B 21/1663; A63B 21/4027; A63B 21/4033; A63B 21/4035

See application file for complete search history.

(56) References Cited

U.S. PATENT DOCUMENTS 3,785,644 A * 1/1974 Bradley ..... A63B 21/015 73/379.06

4,293,127 A * 10/1981 Dudley ..... A63B 21/1627 482/120

(Continued)

*Primary Examiner* — Andrew S Lo

*Assistant Examiner* — Zachary T Moore

(74) *Attorney, Agent, or Firm* — Kilpatrick Townsend & Stockton LLP

(57) ABSTRACT

In one example, an exercise apparatus comprises: a shaft; a roller wheel mounted on and rotatable around the shaft; a first pair of gripping members formed on two opposite ends of the shaft; a second pair of gripping members, each of the second pair of gripping members being formed on the shaft between one of the first pair of gripping members and the roller wheel; and a wall-mounting device connected to the shaft, the wall-mounting device being configured to be mounted on a wall above a top portion of a door frame to suspend the second pair of gripping members and the roller wheel in a space below the top portion of the door frame while the first pair of gripping members is in contact with two side portions of the door frame.

12 Claims, 9 Drawing Sheets

(56) References Cited

U.S. PATENT DOCUMENTS

| | | | | | |
|---|---|---|---|---|---|
| 4,416,271 | A * | 11/1983 | Chester | A61H 15/00 | 482/904 |
| 4,844,448 | A * | 7/1989 | Niznik | A63B 21/4047 | 482/40 |
| 5,180,350 | A * | 1/1993 | Thomas | A63B 1/00 | 482/40 |
| 5,752,903 | A * | 5/1998 | Chang | A63B 21/00047 | 482/141 |
| 5,857,949 | A * | 1/1999 | Tebbe | A63B 23/0211 | 482/131 |
| 6,179,748 | B1 * | 1/2001 | Barr | A63B 21/1627 | 482/40 |
| 6,652,419 | B1 * | 11/2003 | Rota | A63B 5/11 | 482/28 |
| 8,622,875 | B2 * | 1/2014 | Ho | A63B 3/00 | 482/40 |
| 11,213,712 | B1 * | 1/2022 | Lejuez | A63B 23/1209 | |
| 2005/0250619 | A1 * | 11/2005 | Daikeler | A63B 1/00 | 482/40 |
| 2012/0046150 | A1 * | 2/2012 | Stacey | A63B 23/0216 | 482/131 |
| 2013/0288861 | A1 * | 10/2013 | Cole | A63B 21/1636 | 482/102 |
| 2014/0106949 | A1 * | 4/2014 | Mestemaker | A63B 21/1636 | 482/129 |
| 2014/0371040 | A1 * | 12/2014 | Vasquez | A63B 23/1236 | 482/39 |
| 2017/0266486 | A1 * | 9/2017 | Anderson | A63B 21/4034 | |

* cited by examiner

MULTI-PURPOSE EXERCISE DEVICE

RELATED APPLICATION

This patent application claims priority to U.S. Provisional Patent Application Ser. No. 63/013,799, filed Apr. 22, 2020, entitled "Exercise Device" and which is assigned to the assignee hereof and is incorporated herein by reference in its entirety for all purposes.

BACKGROUND

An exercise device typically only supports one form of exercise. For example, an abdomen roller supports an abdomen rollout exercise. However, the abdomen roller cannot support a different type of exercise, such as a pull-up exercise or a dip exercise. A user may have to procure a large number of exercise devices for different exercises. Each of these extra exercise devices may only support a single type of exercise, may be costly to procure, and may require lots of space for storage, all of which can degrade user experience.

BRIEF SUMMARY

Aspects of the disclosure relate to an exercise device, and more particularly, to a multi-purpose exercise device.

In one example, an exercise apparatus is provided. The exercise apparatus includes: a shaft; a roller wheel mounted on and rotatable around the shaft; a first pair of gripping members formed on two opposite ends of the shaft; a second pair of gripping members, each of the second pair of gripping members being formed on the shaft between one of the first pair of gripping members and the roller wheel; and a wall-mounting device connected to the shaft, the wall-mounting device being configured to be mounted on a wall above a top portion of a door frame to suspend the second pair of gripping members and the roller wheel in a space below the top portion of the door frame while the first pair of gripping members is in contact with two side portions of the door frame.

In some aspects, the shaft, the roller wheel, the first pair of gripping members, and the second pair of gripping members are configured as part of an exercise roller device when the wall-mounting device is not mounted on a wall.

In some aspects, the wall-mounting device comprises a pair of L-shaped members; and a connecting member that connects the pair of L-shaped members together, the connecting member being parallel with the shaft. The connecting member is supported on the top portion of the door frame when mounted on the wall above the top portion of the door frame.

In some aspects, the apparatus further comprises a third pair of gripping members formed on two ends of the pair of L-shaped members.

In some aspects, the second pair of gripping members and the third pair of gripping members are configured as part of pull-up bars when the wall-mounting device is mounted on the wall above the top portion of the door frame.

In some aspects, the wall-mounting device comprises a pair of strings and a pair of rings tied to the pair of strings. The pair of rings are configured to hold onto hooks 270 on the wall. The pair of strings are configured to suspend the shaft, the roller wheel, the first pair of gripping members; and the second pair of gripping members from the wall.

In some aspects, the pair of L-shaped members is a first pair of L-shaped members. The connecting member is a first connecting member. The exercise apparatus further comprises an extension device detachably mounted on the shaft. The extension device comprises a second pair of L-shaped members connected by a second connecting member, the second connecting member being parallel with the shaft when the extension device is mounted on the shaft.

In some aspects, the exercise apparatus further comprises a fourth pair of gripping members formed on two ends of the second pair of L-shaped members to provide a pair of dip-bars.

In some aspects, the exercise apparatus further comprises u-shaped members on two ends of the second pair of L-shaped members; the u-shaped members being configured to mount onto shaft to connect the second pair of L-shaped members to the shaft.

In some aspects, openings of the u-shaped members face horizontal portions of the L-shaped members, the horizontal portions of the L-shaped members being parallel with the shaft.

In some aspects, the shaft comprises a solid bar.

In some aspects, two ends of the shaft are bendable to set an angle between each of the first pairs of gripping members and the shaft.

BRIEF DESCRIPTION OF DRAWINGS

Non-limiting and non-exhaustive aspects are described with reference to the following figures, wherein like reference numerals refer to like parts throughout the various figures unless otherwise specified.

DETAILED DESCRIPTION

Figure 1A:
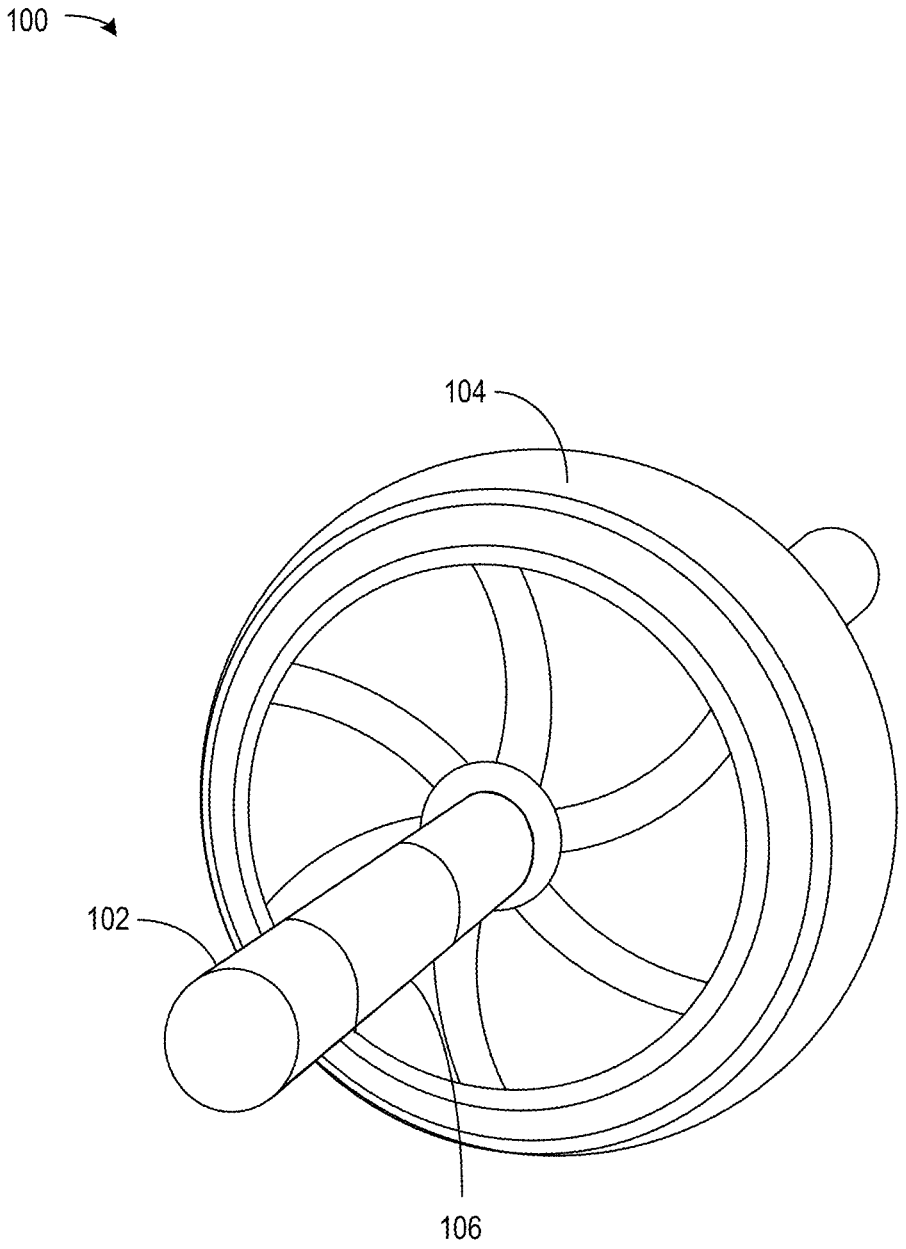
FIG. 1A and FIG. 1B illustrate an example exercise roller device and its operations.

Several illustrative examples will now be described with respect to the accompanying drawings, which form a part hereof. While particular examples, in which one or more aspects of the disclosure may be implemented, are described below, other examples may be used and various modifications may be made without departing from the scope of the disclosure or the spirit of the appended claims.

An exercise device typically only supports one form of exercise. For example, an abdomen roller supports an abdomen rollout exercise. However, the abdomen roller cannot support a different type of exercise, such as a pull-up exercise or a dip exercise. A user may have to procure a large number of exercise devices for different exercises. Each of these extra exercise devices may only support a single type of exercise, may be costly to procure, and may require lots of space for storage, all of which can degrade user experience.

Disclosed are examples of a multi-purpose exercise device that can address at least some of the issues described above. In some examples, the multi-purpose exercise device includes a shaft, a roller wheel mounted on and rotatable around the shaft, and pairs of gripping members formed on two sides of the roller wheel. The pairs of gripping members can include a first pair of gripping members formed on opposite ends of the shaft. The first pair of gripping members can be parallel with the shaft. In some examples, the first pair of gripping members can be bendable to form a certain angle with the shaft. In addition, a second pair of gripping members can be formed between the roller wheel and the first pair of gripping members. The shaft, the roller wheel, and the gripping members can form an exercise roller device. A user can grab the first pair of gripping members or the second pair of gripping members and roll the roller wheel on a surface to perform an abdomen rollout exercise.

In addition, the multi-purpose exercise device includes a wall-mounting device connected to the shaft. The wall-mounting device can be mounted above ground (e.g., on a wall and/or above a door frame) to suspend the gripping members, the shaft, and the roller wheel in the air. When the multi-purpose exercise device is mounted above ground, it can be used as a pull-up bar device, and a user can perform a pull-up exercise by holding, for example, the second pair of gripping members around the roller wheel.

In some examples, the wall-mounting device can include a frame structure, which can include a pair of L-shaped members each comprising a vertical portion and a horizontal portion. The vertical portions of the L-shaped members can be connected together by a connecting member parallel with the shaft to form a rigid frame structure, whereas the horizontal portions of the L-shaped members can be connected to the shaft on two sides of the roller wheel. A third pair of gripping members can be formed at the ends of the horizontal portions of the L-shaped members. In a case where the wall-mounting device is mounted above a top portion of a door frame to provide a pull-up bar device, the connecting member can be supported on the top portion of the door frame, whereas the first pair of gripping members on the opposite ends of the shaft can be pressed against the two side portions of the door frame when the user holds the second pair of gripping members or the third pair of gripping members, both which can remain in the space below the top portion of the door frame. This can keep the wall-mounting device stably mounted above the door frame during the pull-up exercise. In some examples, the wall-mounting device includes a pair of strings connected to the shaft. The pair of strings can include rings to hold onto hooks 270 on a vertical wall above the door frame to suspend the shaft (and the first gripping members on two ends of the shaft) in the air.

In some examples, the multi-purpose exercise device can include an extension device which can be mounted on the shaft, when the shaft is suspended in the air, to provide a pair of dip bars. The extension can also include a second pair of L-shaped members each comprising a vertical portion and a horizontal portion. The second pair of L-shaped members can be connected together by a second connecting member to form a second rigid frame structure. A fourth pair of gripping members can be formed on the ends of the horizontal portions of the extension device to form a pair of dip bars. Optionally, one or more gripping members can also be formed on the second connecting member to provide another dip bar or another pull-up bar. In addition, the vertical portions of the extension device include u-shaped members to mount onto the shaft. In some examples, the openings of the u-shaped members can be facing towards the horizontal portions of the extension device. With such arrangements, when the extension device is mounted onto the shaft, which is pressed against the door frame under the weight of the user, the shaft can also press the vertical portions and the second connecting member against the door frame, which allow the extension device to be stably attached to the shaft during the dip exercise.

With the disclosed techniques, a single piece of a multi-purpose exercise device can support both an abdomen rollout exercise, when the device is rolled on a surface, and a pull-up exercise, when the device is mounted at a high point. The multi-purpose exercise device also provides a secure mechanism to mount an extension device to form a dip-bar. As a result, there is no need to have separate and standalone exercise devices to support different types of exercises, which can improve user experience.

Figure 1B:
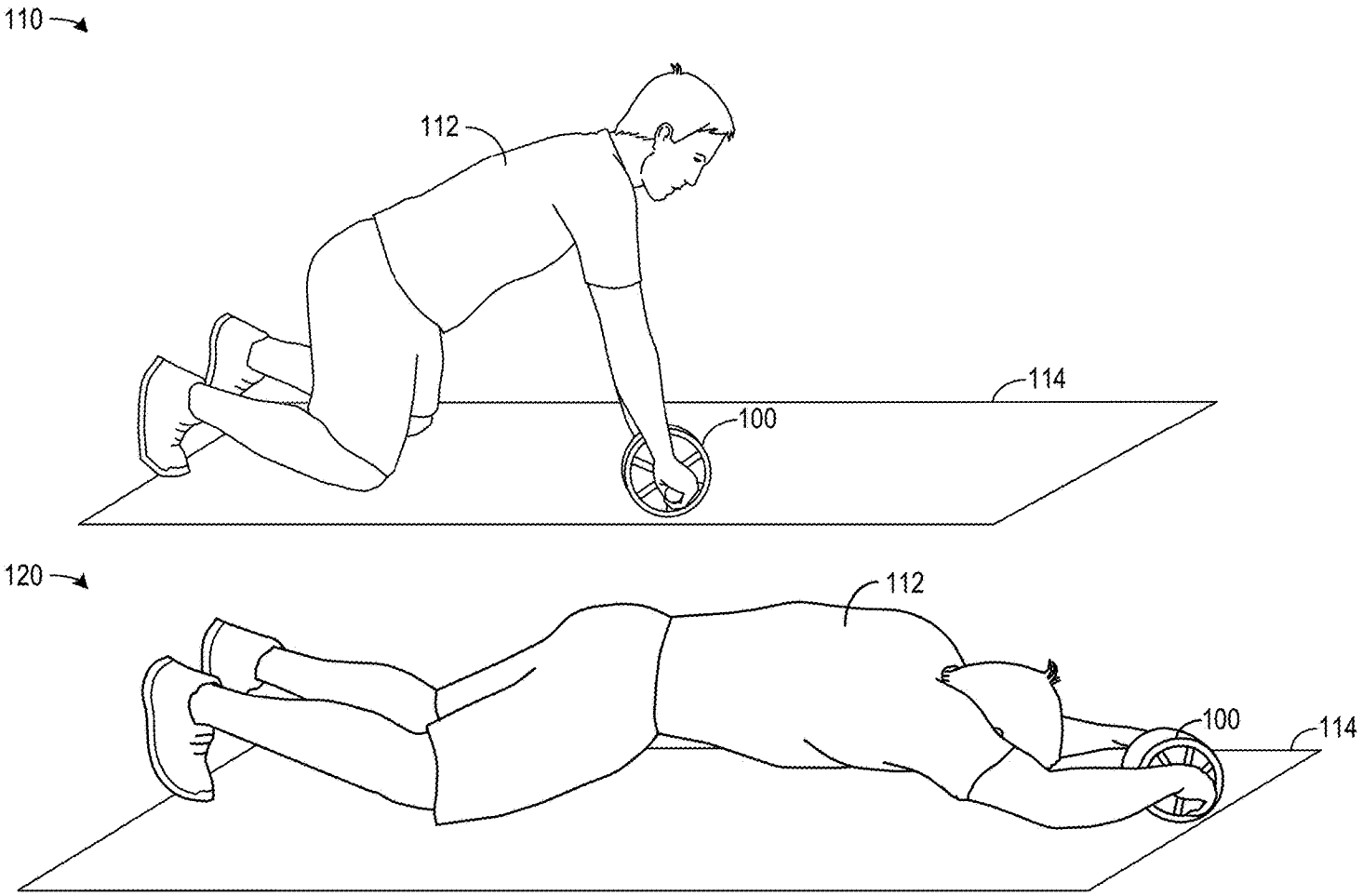

FIG. 1A illustrates an example of an abdominal roller device 100. As shown in FIG. 1A, abdominal roller device 100 includes a shaft 102 and a roller wheel 104, a pair of gripping members 106 (one gripping member 106 shown in FIG. 1A) formed on shaft 102 and on two sides of the roller wheel. FIG. 1B illustrates an abdomen rollout exercise supported by abdominal roller device 100. In a first step 110, a user 112 can kneel on ground 114 while holding abdominal roller device 100 at gripping members 106, with abdominal roller device 100 underneath the shoulders of the user. In a second step 120, user 112 can then engage his/her core muscles and roll abdominal roller device 100 forwards and then backwards. The user can try to keep his/her posture during the rolling motion to train the strength of the core muscles.

Abdominal roller device 100 of FIG. 1A typically only supports the abdomen rollout exercise of FIG. 1B but not any other types of exercises, such as pull-up exercises or dip exercises. The user may need to procure standalone exercise devices such as pull-up bars and dip-bars for those exercises. The user may have to procure a large number of exercise devices for different exercises. Each of these extra exercise devices may only support a single type of exercise, may be costly to procure, and may require lots of space for storage, all of which can degrade user experience.

Figure 2A:
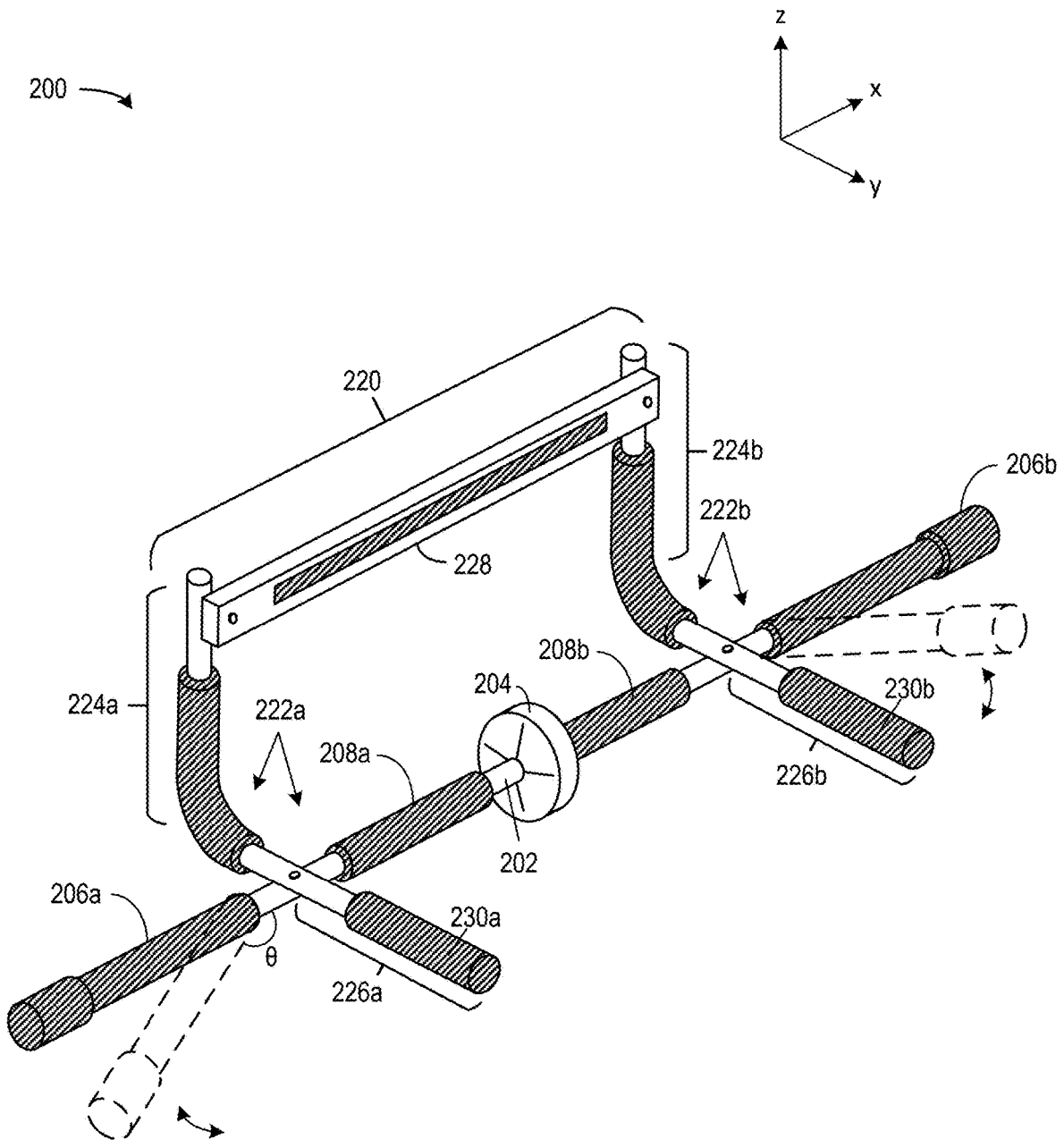
FIG. 2A, FIG. 2B, FIG. 2C, and FIG. 2D illustrate examples of a multi-purpose exercise device and its operations, according to certain aspects of the present disclosure.

FIG. 2A illustrates an example of a multi-purpose exercise device/apparatus 200 that can address at least some of the issues described above. As shown in FIG. 2A, multi-purpose exercise device 200 includes a shaft 202, a roller wheel 204 mounted on and rotatable around shaft 202, and pairs of gripping members formed on two sides of the roller wheel. The pairs of gripping members can include a first pair of gripping members 206 (206*a* and 206*b*) formed on opposite ends of the shaft. First pair of gripping members 206 can be parallel with shaft 202, as shown in FIG. 2A. In some examples, the opposite ends of shaft 202 can be bendable, which allows first pair of gripping members 206 to bend to form a certain angle θ with the shaft. In addition, the pairs of gripping members can include a pair of second gripping members 208 (208*a* and 208*b*), with each second gripping member formed between roller wheel 204 and each of first pair of gripping members 206*a* and 206*b*. The gripping members can be made of rubber, fabric, foam, etc., and can include non-slipping textures to allow a user to easily hold the gripping members. Shaft 202 and roller wheel 204 can be made of any rigid materials, such as metal (e.g., steel), wood, or plastic. In some examples, shaft 202 can be made as a solid bar to provide stronger support and stability. In some examples, shaft 202 can be made of different materials. For example, the opposite ends of shaft 202 can be made of a bendable material (e.g., plastic), whereas the rest of shaft 202 can be made of a rigid material (e.g., metal).

Figure 2B:
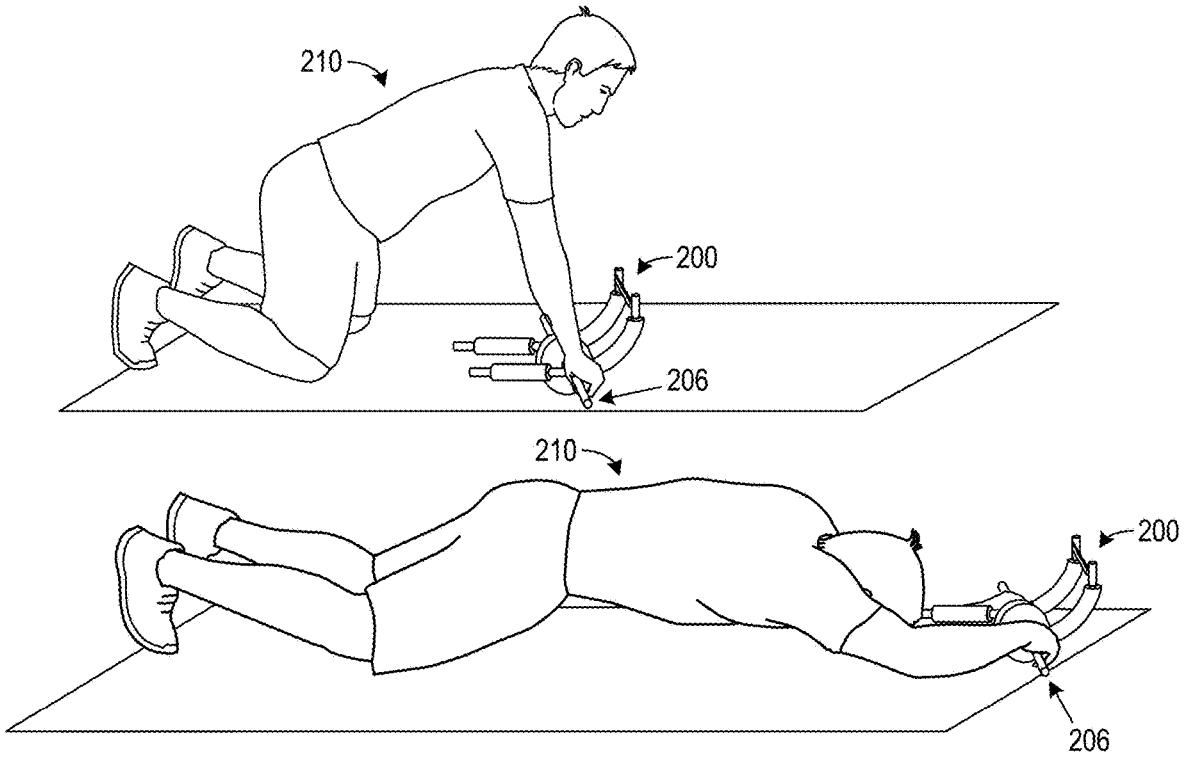

Referring to FIG. 2B, shaft 202, roller wheel 204, and gripping members 206 and 208 can form an exercise roller device. A user 210 can hold first pair of gripping members 206, as shown in FIG. 2B, or second pair of gripping members 208, and roll the roller wheel on a surface to perform an abdomen rollout exercise as in FIG. 1B. The bendable first pair of gripping members 206 allow the user to hold the gripping members with different upper body postures, which can improve the exercise of the upper body muscles.

Referring back to FIG. 2A, multi-purpose exercise device 200 further includes a wall-mounting device 220 connected to shaft 202. Wall-mounting device 220 can be mounted above ground (e.g., on a wall and/or above a door frame) to suspend gripping members 206 and 208, shaft 202, and roller wheel 204 in the air. When multi-purpose exercise device 200 is mounted above ground, second pair of gripping members 208 can be used as a pull-up bar device, and a user can perform a pull-up exercise by grabbing the first or second pair of gripping members.

In some examples, as shown in FIG. 2A, wall-mounting device 220 can include a frame structure, which can include a pair of L-shaped members 222*a* and 222*b* each comprising a vertical portion 224 (224*a* and 224*b*) and a horizontal portion 226 (226*a* and 226*b*). When mounted on a vertical wall (e.g., parallel with the z-axis), vertical portion 224 can become parallel with the vertical wall, whereas horizontal portion 226 can be parallel with a horizontal surface (e.g., parallel with the x-y plane). L-shaped members 222*a* and 222*b* can include hollow tubes to reduce weight. In FIG. 2A, vertical portion 224 and horizontal portion 226 can form an angle of about 90 degrees, but in other examples, vertical portion 224 and horizontal portion 226 can form an angle larger than or smaller than 90 degrees. Vertical portions 224*a* and 224*b* can be connected together by a connecting member 228, which can be parallel with shaft 202, to form a rigid frame structure. Moreover, horizontal portions 226*a* and 226*b* can be connected to shaft 202 on two sides of roller wheel 204. A third pair of gripping members 230*a* and 230*b* can be formed at the ends of horizontal portions 226*a* and 226*b*. When multi-purpose exercise device 200 is mounted at a high point, a user can hold the second pair of gripping members 208 or the third pair of gripping members 230 to perform a pull-up exercise.

Referring back to FIG. 2B, the L-shaped members 222 can create a separation between first pair of gripping members 206/second pair of gripping members 208 and connecting member 228 when the user operates multi-purpose exercise device 200 as an exercise roller device. This can reduce the likelihood of the user hitting his/her head with connecting member 228 when the user slips or otherwise loses control and falls on the surface, which can improve safety.

Figure 2C:
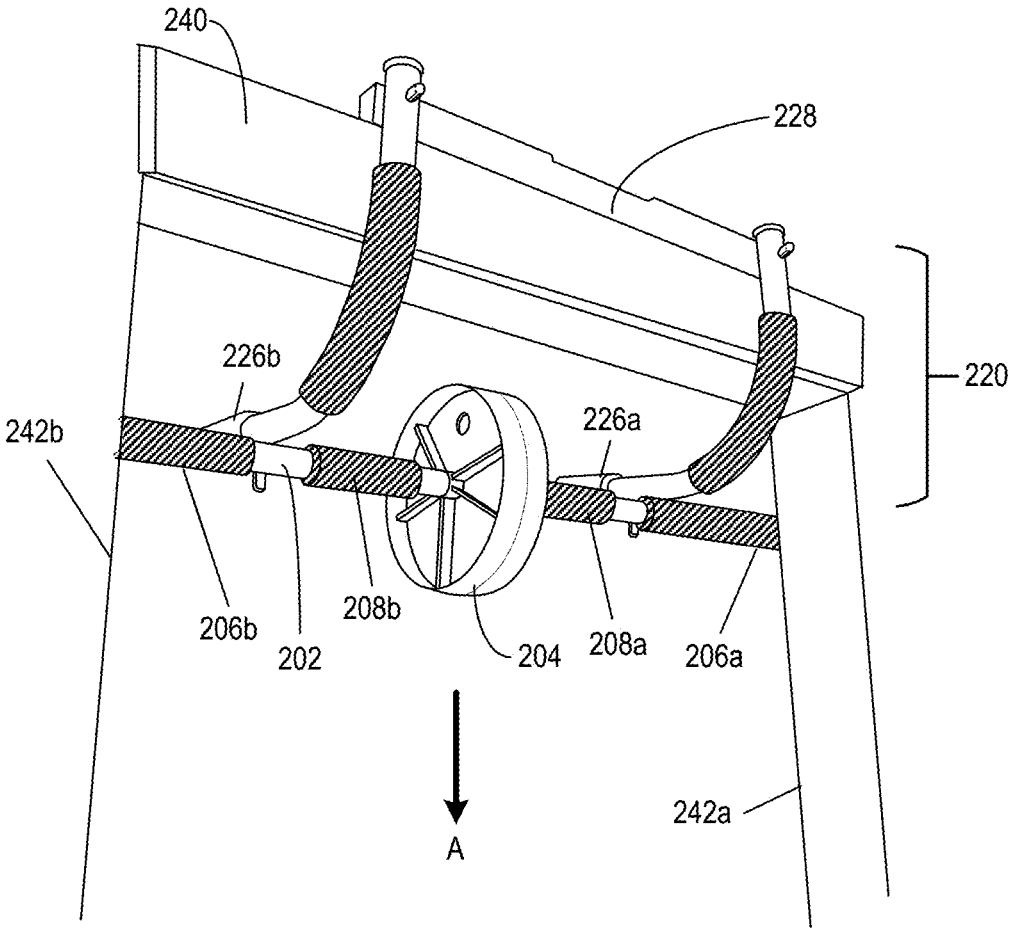

FIG. 2C illustrates an example way of mounting multi-purpose exercise device 200 at a high point to provide a pull-up bar device. As shown in FIG. 2C, to mount wall-mounting device 220 above a top portion 240 of a door frame, connecting member 228 can be supported on top portion 240 of the door frame. Moreover, first pair of gripping members 206*a* and 206*b* are parallel with shaft 202 and can be pressed against two side portions 242*a* and 242*b* of the door frame, when the user holds down second pair of gripping members 208 or third pair of gripping members 230*a* and 230*b* (indicated by direction A in FIG. 2C), both of which can remain in the space below the top portion of the door frame. This can keep wall-mounting device 220 stably mounted above the door frame during the pull-up exercise.

Figure 2D:
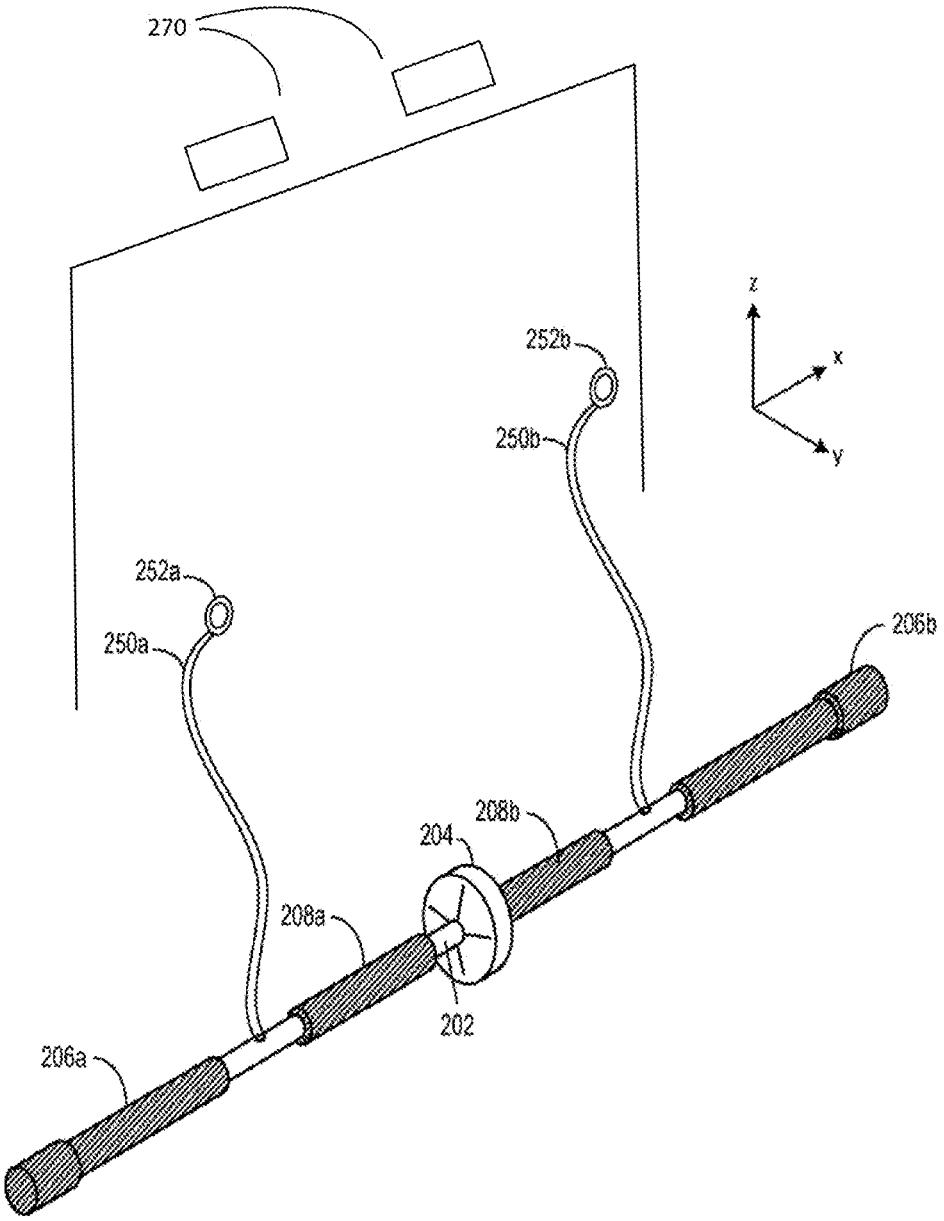

FIG. 2D illustrates a wall-mounting device that includes a pair of strings 250*a* and 250*b* connected to shaft 202. One end of each of strings 250*a* and 250*b* can be attached to, respectively, a ring 252*a* and 252*b*, whereas the other end of each of strings 250*a* and 250*b* can be attached to shaft 202. Rings 252*a* and 252*b* can be used to hold onto hooks 270 on a vertical wall above the door frame to suspend shaft 202 as well as first pair of gripping members 206 and second pair of gripping members 208 in the air. A user can then hold one of the pairs of gripping members to perform a pull-up exercise. When multi-purpose exercise device 200 is used as an exercise roller device, strings 250*a* and 250*b* can be detached from shaft 202 so as not to impede the rolling of roller wheel 204.

Figure 3A:
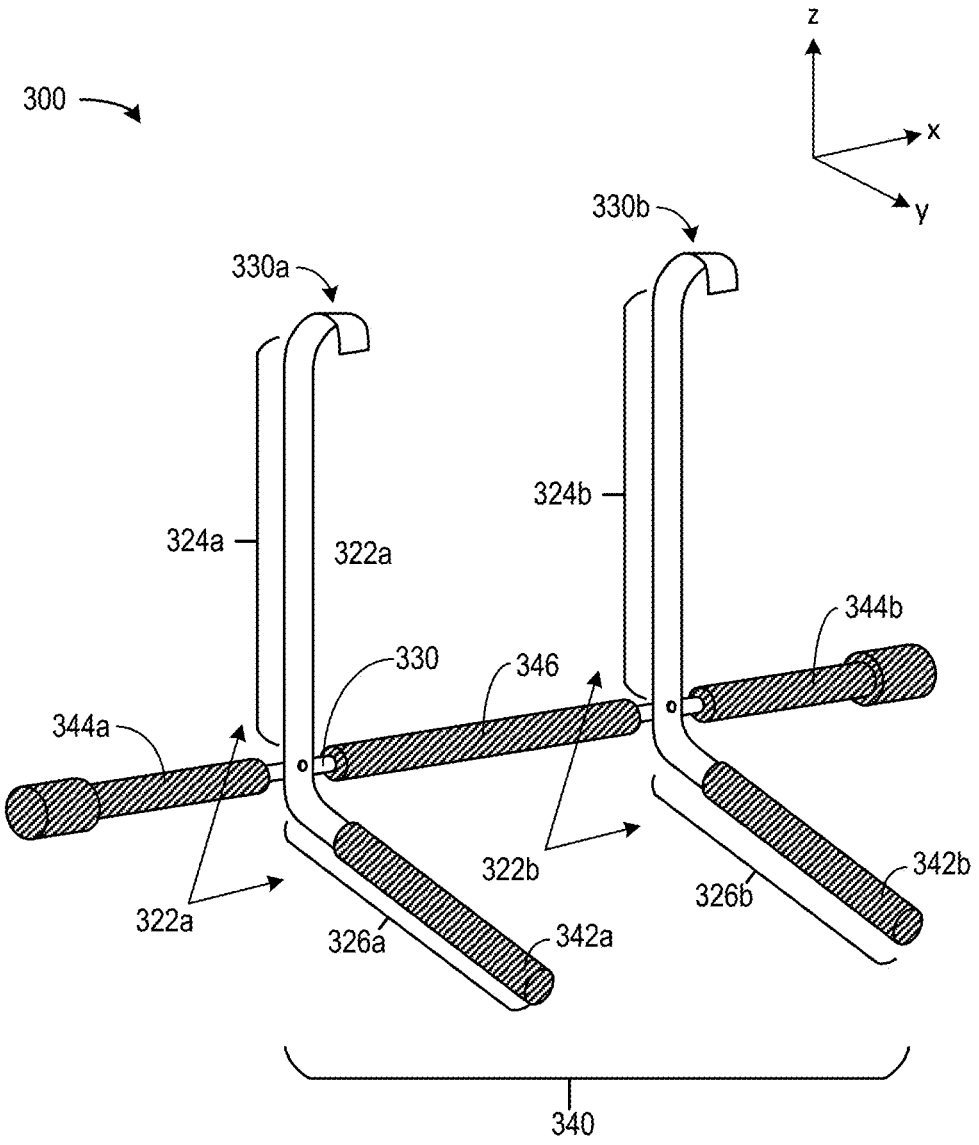
FIG. 3A, FIG. 3B, and FIG. 3C illustrate additional examples of a multi-purpose exercise device and its operations, according to certain aspects of the present disclosure.
Figure 3B:
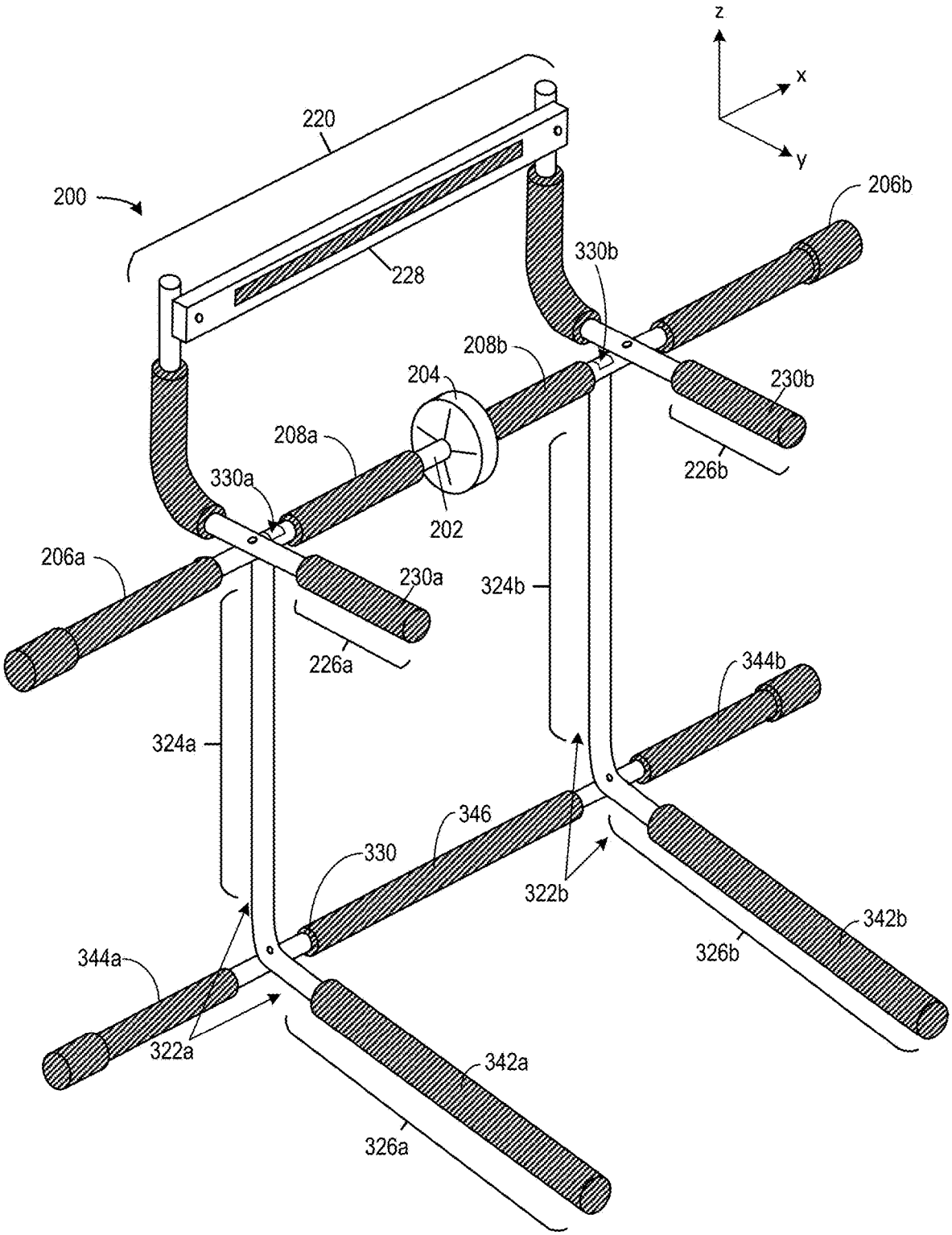

In some examples, multi-purpose exercise device 200 can include a detachable extension device which, when attached to shaft 202, can be used to support a different type of exercise, such as a dip-bar exercise. FIG. 3A illustrates an example of extension device 300, which can be detached/attached on shaft 202 when wall-mounting device 220 is mounted at a high point (e.g., above a door frame), whereas FIG. 3B illustrates multi-purpose exercise device 200 including extension device 300, which can be detached/attached on shaft 202. Extension device 300 includes a pair of L-shaped members 322*a* and 322*b*, each comprising a vertical portion 324 (324*a* and 324*b*) and a horizontal portion 326 (326*a* and 326*b*). Each of L-shaped members 322*a* and 322*b* can include hollow tubes to reduce weight. Each of vertical portions 324*a* and 324*b* includes, respectively, a u-shaped member 330*a* and 330*b* to mount onto shaft 202. When attached to shaft 202 while wall-mounting device 220 is mounted to a vertical wall (e.g., parallel with the z-axis), vertical portions 324 can be parallel with the vertical wall and parallel with the z-axis, whereas horizontal portions 326 can be parallel with a horizontal surface (e.g., parallel with the x-y plane). In FIG. 3A, vertical portion 324 and horizontal portion 326 can form an angle of about 90 degrees, but in other examples, vertical portion 324 and horizontal portion 326 can form an angle larger than or smaller than 90 degrees. L-shaped members 322*a* and 322*b* can be connected together by a connecting member 330 to form a rigid frame structure 340. A fourth pair of gripping members 342 (342*a* and 342*b*) can be formed on the ends of horizontal portions 326 of extension device 300 to form a pair of dip bars. Optionally, one or more gripping members, such as a fifth pair of gripping members 344*a*, 344*b*, and a gripping member 346, can also be formed on connecting member 330 to provide another dip bar or another pull-up bar. Connecting member 330 can be made of a solid bar, which can be made of, for example, metal (e.g., steel), plastic, or wood, for stronger support and stability.

Figure 3C:
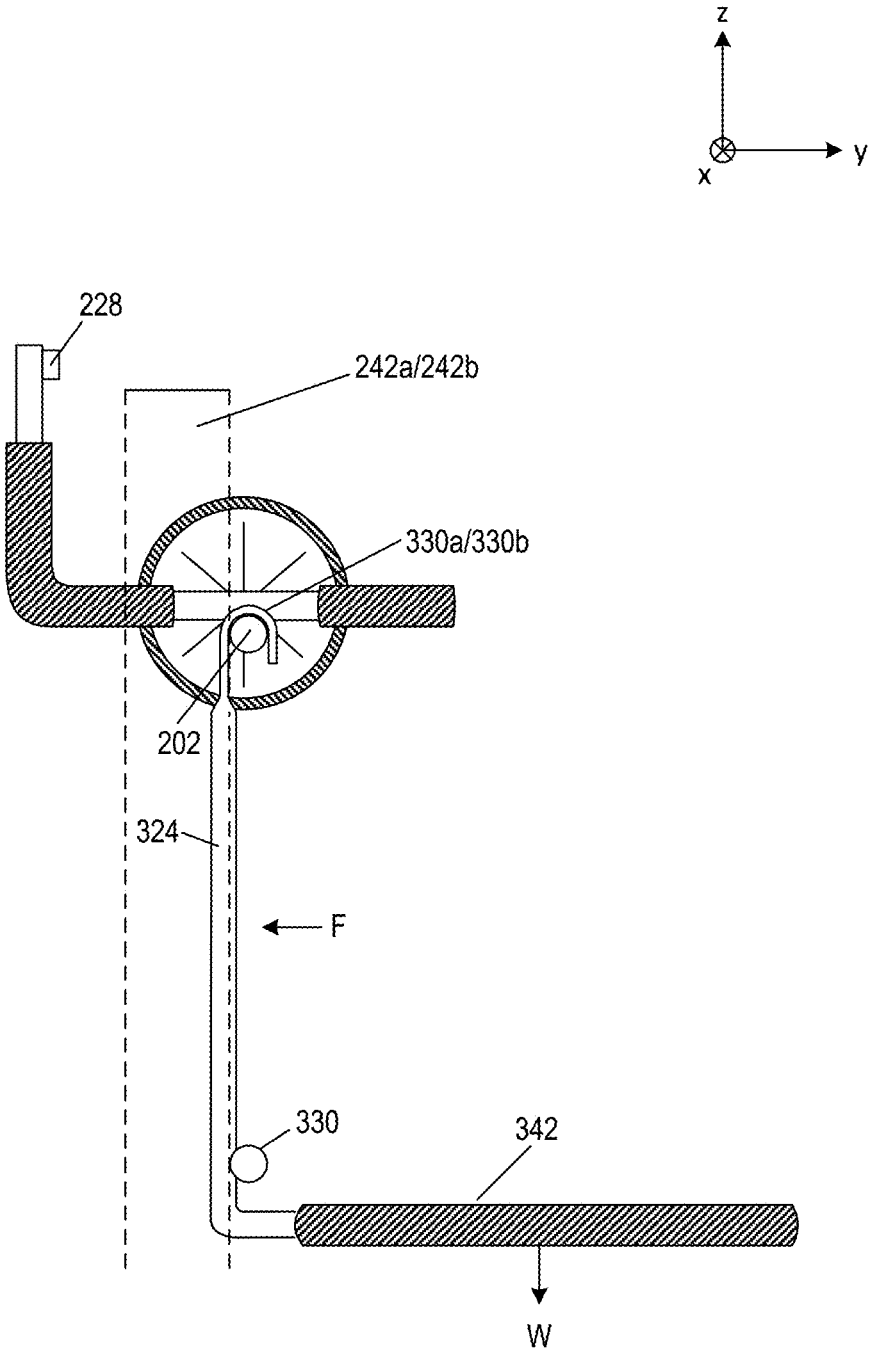

In FIG. 3A, the openings of u-shaped members 330*a* and 330*b* can be facing towards horizontal portions 326*a* and 326*b*. As shown in FIG. 3B, with such arrangements, u-shaped members 330*a* and 330*b* can be mounted onto shaft 202 such that part of vertical portions 324*a* and 324*b* are behind shaft 202 and away from the user rather than facing the user. Such arrangements allow extension device 300 to be more stably mounted onto shaft 202. Referring to FIG. 3C, when shaft 202 is pressed against side portions 242*a*/242*b* of the door frame by a force F under a weight W of the user, vertical portions 324 and connecting member 330 can also be pressed against side portions 242*a*/242*b* of the door frame by force F. The pressing allow extension device 300 to be stably mounted onto shaft 202 during the dip exercise.

The techniques and apparatuses discussed above are examples. Various configurations may omit, substitute, or add various procedures or components as appropriate. For instance, in alternative configurations, the methods may be performed in an order different from that described, and/or various stages may be added, omitted, and/or combined.

Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

The invention claimed is:

1. An exercise apparatus comprising:

a shaft;

a roller wheel axially coupled to and rotatable relative to the shaft, wherein an axis of rotation of the roller wheel is coaxially aligned with an axis of the shaft;

a first pair of gripping members formed on two opposite ends of the shaft;

a second pair of gripping members, each gripping member of the second pair of gripping members being formed on the shaft between one of the first pair of gripping members and the roller wheel; and a wall-mounting device connected to the shaft, the wall-mounting device being configured to be mounted on a wall above a top portion of a door frame to suspend the second pair of gripping members and the roller wheel in a space below the top portion of the door frame while the first pair of gripping members is in contact with two side portions of the door frame.

2. The exercise apparatus of claim 1, wherein the shaft, the roller wheel, the first pair of gripping members, and the second pair of gripping members are configured as part of an exercise roller device when the wall-mounting device is not mounted on a wall.

3. The exercise apparatus of claim 1, wherein the wall-mounting device comprises:

a pair of L-shaped members; and a connecting member that connects the pair of L-shaped members together, the connecting member being parallel with the shaft, and wherein the connecting member is supported on the top portion of the door frame when mounted on the wall above the top portion of the door frame.

4. The exercise apparatus of claim 3, further comprising a third pair of gripping members formed on two ends of the pair of L-shaped members.

5. The exercise apparatus of claim 4, wherein the second pair of gripping members and the third pair of gripping members are configured as part of pull-up bars when the wall-mounting device is mounted on the wall above the top portion of the door frame.

6. The exercise apparatus of claim 3, wherein the pair of L-shaped members is a first pair of L-shaped members, wherein the connecting member is a first connecting member, wherein the exercise apparatus further comprises an extension device detachably mounted on the shaft, and wherein the extension device comprises a second pair of L-shaped members connected by a second connecting member, the second connecting member being parallel with the shaft when the extension device is mounted on the shaft.

7. The exercise apparatus of claim 6, wherein further comprising a fourth pair of gripping members formed on two ends of the second pair of L-shaped members to provide a pair of dip-bars.

8. The exercise apparatus of claim 6, further comprising u-shaped members on two ends of the second pair of L-shaped members, the u-shaped members being configured to mount onto shaft to connect the second pair of L-shaped members with the shaft.

9. The exercise apparatus of claim 8, wherein openings of the u-shaped members face horizontal portions of the second pair of L-shaped members, the horizontal portions of the second pair of L-shaped members being along a parallel horizontal plane with the shaft.

10. The exercise apparatus of claim 1, wherein the wall-mounting device comprises a pair of strings and a pair of rings tied to the pair of strings, wherein the pair of rings are configured to hold onto hooks on a vertical wall above the door frame, and wherein the pair of strings are configured to suspend the shaft, the roller wheel, the first pair of gripping members; and the second pair of gripping members from the wall.

11. The exercise apparatus of claim 1, wherein the shaft comprises a solid bar.

12. The exercise apparatus of claim 11, wherein the two opposite ends of the shaft are bendable to set an angle between each of the first pairs of gripping members and the shaft.

* * * * *